US007186127B2

(12) United States Patent
Montena

(10) Patent No.: US 7,186,127 B2
(45) **Date of Patent: *Mar. 6, 2007**

(54) NUT SEAL ASSEMBLY FOR COAXIAL CONNECTOR

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/876,386

(22) Filed: Jun. 25, 2004

(65) Prior Publication Data

US 2005/0176294 A1 Aug. 11, 2005

(51) Int. Cl.
*H01R 13/52* (2006.01)

(52) U.S. Cl. ..... 439/277; 411/428

(58) Field of Classification Search ..... 439/271, 439/277, 320, 578, 675; 411/428, 915, 947
See application file for complete search history.

(56) References Cited

U.S. PATENT DOCUMENTS

| | | | | |
|---|---|---|---|---|
| 3,328,746 | A | 6/1967 | Schumacher | |
| 3,449,706 | A | 6/1969 | Carissimi | |
| 3,520,342 | A * | 7/1970 | Scheffer | 411/303 |
| 3,530,425 | A | 9/1970 | Vachhani | |
| 3,668,612 | A | 6/1972 | Nepovim | |
| 3,910,673 | A | 10/1975 | Stokes | |
| 4,046,451 | A | 9/1977 | Juds et al. | |
| 4,126,170 | A * | 11/1978 | DeHaitre | 411/303 |
| 4,138,198 | A * | 2/1979 | Brown | 403/247 |
| 4,173,385 | A | 11/1979 | Fenn et al. | |

(Continued)

OTHER PUBLICATIONS

U.S. Appl. No. 11/322,097, filed Dec. 29, 2005, Montena.

*Primary Examiner*—Thanh-Tam Le
(74) *Attorney, Agent, or Firm*—Wall Marjama & Bilinski LLP

(57) ABSTRACT

An integrated seal assembly and a connector incorporating the seal assembly for connecting a coaxial cable to an externally threaded port. The seal assembly includes a bellows-type seal having an elastically deformable tubular body and a plurality of sealing surfaces, and an integral joint-section intermediate an anterior end and a posterior end that assists in the axial deformation of the seal in response to axially-directed force. One of the sealing surfaces is made to engage a corresponding surface of an internally threaded nut. The nut and attached seal form an integral seal assembly. A coaxial cable connector includes a connector body. One end of the body attaches a coaxial cable, the seal assembly being rotatably attached to the other end. The connector is engagable with an externally threaded port via the internally threaded nut component of the connector. The anterior end of the seal fits over the port and a sealing surface of the seal is capable of sealing axially against a shoulder of the port while the seal body covers the otherwise exposed externally threaded port. Upon tightening of the nut on the port, the seal deflects in the axial direction to accommodate a variety of distances between the connector and the shoulder of the port. Additionally, the seal is capable of expanding to allow a second sealing surface to contact and seal against a variety of smooth outside diameters of the port. The versatility of the seal allows an operator to use one connector on a wide variety of externally threaded ports without the risk of a faulty seal at the connection or a poor connection due to an improper seal.

12 Claims, 15 Drawing Sheets

U.S. PATENT DOCUMENTS 4,296,950 A * 10/1981 Chamberlin ..... 285/45
4,367,060 A 1/1983 Berecz
4,433,889 A 2/1984 Ratchford et al.
4,447,103 A 5/1984 Werth et al.
4,659,272 A * 4/1987 Pratt ..... 411/43
4,674,818 A 6/1987 McMills et al.
4,717,355 A 1/1988 Mattis
4,824,400 A 4/1989 Spinner
4,869,679 A 9/1989 Szegda
4,902,246 A 2/1990 Samchisen
4,907,924 A 3/1990 Hellon
4,960,342 A * 10/1990 Chi ..... 403/24
5,011,432 A 4/1991 Sucht et al.
5,127,853 A 7/1992 McMills et al.
5,278,525 A 1/1994 Palinkas
5,283,853 A 2/1994 Szegda
5,284,449 A 2/1994 Vaccaro
5,322,454 A 6/1994 Thommen
5,342,096 A * 8/1994 Bachle et al. ..... 285/23
5,435,745 A 7/1995 Booth
5,454,675 A 10/1995 DeHaitre
5,561,900 A 10/1996 Hosler, Sr.
5,571,028 A * 11/1996 Szegda ..... 439/322
5,651,698 A * 7/1997 Locati et al. ..... 439/578
5,662,489 A 9/1997 Stirling
5,681,189 A 10/1997 Dunham
5,766,037 A 6/1998 Nelson
5,795,188 A 8/1998 Harwath
5,857,865 A 1/1999 Shimirak et al.
5,866,849 A 2/1999 Tuvy et al.
5,938,474 A 8/1999 Nelson
5,980,315 A 11/1999 Matsuda et al.
5,984,723 A 11/1999 Wild
5,993,254 A 11/1999 Pitschi et al.
6,019,636 A 2/2000 Langham
6,032,358 A 3/2000 Wild
6,053,749 A 4/2000 Masuda et al.
6,102,737 A 8/2000 Gohdes
6,234,838 B1 5/2001 Wong
6,298,190 B2 10/2001 Waldron et al.
6,471,545 B1 10/2002 Hosler, Sr.
6,491,546 B1 12/2002 Perry
6,592,403 B2 7/2003 Kooiman
6,692,300 B2 2/2004 Kanda et al.
6,884,113 B1 4/2005 Montena
6,929,265 B2 8/2005 Holland et al.
7,097,500 B2 * 8/2006 Montena ..... 439/587

* cited by examiner

NUT SEAL ASSEMBLY FOR COAXIAL CONNECTOR

FIELD OF THE INVENTION

Embodiments of the invention relate generally to data transmission system components, and more particularly to a nut seal assembly for use with a coaxial cable connector for sealing a threaded port connection, and to a coaxial cable connector incorporating the seal assembly.

BACKGROUND OF THE INVENTION

Community antenna television (CATV) systems and many broadband data transmission systems rely on a network of coaxial cables to carry a wide range of radio frequency (RF) transmission with low amounts of loss and distortion. A covering of plastic or rubber adequately seals an uncut length of coaxial cable from environmental elements such as water, salt, oil, dirt, etc. However, the cable must attach to other cables and/or to equipment (hereinafter, "ports") for distributing or otherwise utilizing the signals carried by the coaxial cable. A service technician or other operator must attach a coaxial cable connector (hereinafter, "connector") to the cut and prepared end of a length of coaxial cable in order to mate the coaxial cable to the port. This is typically done in the field. Environmentally exposed (usually threaded) parts of the connectors and ports are susceptible to corrosion and contamination from environmental elements and other sources, as the connections are typically located outdoors, at taps on telephone polls, on customer premises, or in underground vaults. These environmental elements eventually corrode the electrical connections located in the connector and between the connector and mating components. The resulting corrosion reduces the efficiency of the affected connection, which reduces the signal quality of the RF transmission through the connector. Corrosion in the immediate vicinity of the connector-port connection is often the source of service attention, resulting in high maintenance costs.

Numerous methods and devices have been used to improve the moisture and corrosion resistance of connectors and connections. These include, for example, wrapping the connector with electrical tape, enclosing the connector within a flexible boot which is slid over the connector from the cable, applying a shrink wrapping to the connector, coating the connector with plastic or rubber cement, and employing tubular grommets of the type discussed in U.S. Pat. No. 4,674,818 (McMills et al.) and in U.S. Pat. No. 4,869,679 (Szegda), for example.

Although these methods work, more or less, if properly executed, they all require a particular combination of skill, patience, and attention to detail on the part of the technician or operator. For instance, it may be difficult to apply electrical tape to an assembled connection when the connection is located in a small, enclosed area. Shrink wrapping may be an improvement under certain conditions, but shrink wrap application typically requires applied heat or chemicals, which may be unavailable or dangerous. Rubber-based cements eliminate the need for heat, but the connection must be clean and the cement applied somewhat uniformly. These otherwise attainable conditions may be complicated by cold temperatures, confined or dirty locations, etc. Operators may require additional training and vigilance to seal coaxial cable connections using rubber grommets or seals. An operator must first choose the appropriate seal for the application and then remember to place the seal onto one of the connective members prior to assembling the connection. Certain rubber seal designs seal only through radial compression. These seals must be tight enough to collapse onto or around the mating parts. Because there may be several diameters over which the seal must extend, the seal is likely to be very tight on at least one of the diameters. High friction caused by the tight seal may lead an operator to believe that the assembled connection is completely tightened when it actually remains loose. A loose connection may not efficiently transfer a quality RF signal causing problems similar to corrosion.

Other seal designs require axial compression generated between the connector nut and an opposing surface of the port. An appropriate length seal that sufficiently spans the distance between the nut and the opposing surface, without being too long, must be selected. If the seal is too long, the seal may prevent complete assembly of the connector. If the seal is too short, moisture freely passes. The selection is made more complicated because port lengths may vary among different manufacturers.

In view of the aforementioned shortcomings and others known by those skilled in the art, the inventor has recognized a need for a seal and a sealing connector that addresses these shortcomings and provides other advantages and efficiencies.

SUMMARY OF THE INVENTION

Embodiments of the invention are directed to a seal assembly and to a coaxial cable connector including a seal assembly in accordance with the described embodiments.

An embodiment of the invention is directed to a seal assembly for use with a connector. An intended function of the seal assembly is to prevent the ingress of moisture and contaminants, and the detrimental effects of environmental changes in pressure and temperature on a coaxial cable connection. In an exemplary embodiment, a seal assembly includes a nut component and a bellows-type elastomer seal having an elastically deformable tubular body attached to the nut component, wherein the seal and nut form an integrated seal assembly. In an aspect, the nut component has an interior surface at least a portion of which is threaded, a connector-grasping portion, and a seal-grasping surface portion. The seal-grasping surface portion may be on either the interior or exterior surface of the nut component. In an aspect, at least part of the seal-grasping portion is a smooth surface or a roughened surface suitable to frictionally engage a rear sealing surface of the seal. In an aspect, at least part of the seal-grasping portion is a surface suitable to adhesively engage the rear sealing surface of the seal. In an alternative embodiment, the nut component further includes a nut-turning surface portion along an external perimeter surface of the nut component. In an aspect, the nut-turning surface portion can have at least two flat surface regions suitable for engagement with the jaws of a tool. In an aspect, the nut-turning surface portion is a knurled surface, which lends itself to manual manipulation.

According to an aspect, the seal consists of an elastically deformable tubular body having a forward sealing surface, a rear sealing portion including an sealing surface that integrally engages the nut component, and an integral joint-section intermediate an anterior end and a posterior end of the tubular body, wherein, upon axial compression of the tubular body, the tubular body is adapted to expand radially at the integral joint-section. According to various aspects, the seal is made of a compression molded, elastomer material. In one aspect, the material is a silicone rubber material.

In another aspect, the material is a propylene material. Other suitable elastomers are available.

In an alternative embodiment, the seal assembly further comprises a seal ring having an inner surface and an outer surface, wherein the inner surface has a diameter such that the seal ring is press-fit against an exterior surface of the rear sealing portion of the seal. In an aspect, the seal ring has an outwardly extending flange along a posterior perimeter of the seal ring. In an aspect, the outer surface of the seal ring is knurled.

Another embodiment of the invention is directed to a connector for connecting a coaxial cable to a port. According to an exemplary embodiment, the connector includes a tubular connector body, means for attaching the first end of the connector body to the coaxial cable, and a seal assembly. In an aspect, the seal assembly is the seal assembly in its various aspects described herein above and in the detailed description that follows. An exemplary connector is an F-connector.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1A:
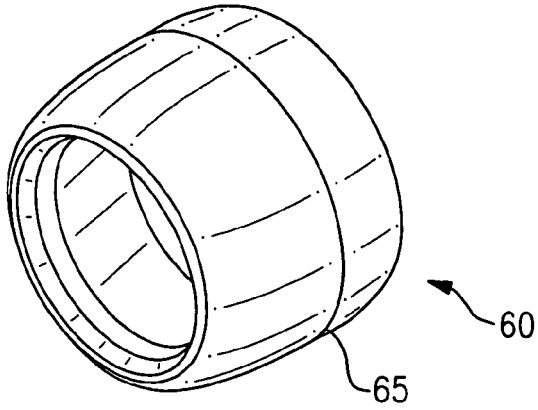
FIGS. 1A, B, C represent a specification drawing of a seal according to an exemplary embodiment of the invention.
Figure 1B:
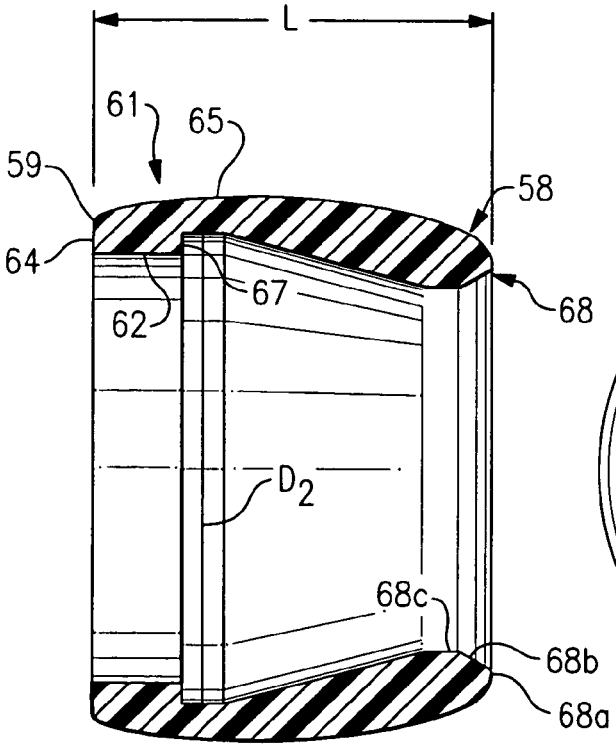
Figure 1C:
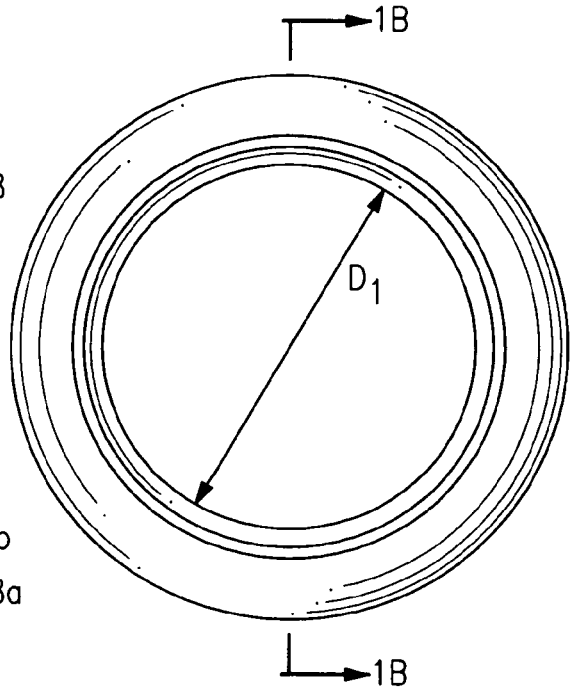

Embodiments of the invention are directed to a seal assembly for use with a coaxial cable connector and to a coaxial cable connector including a seal assembly in accordance with the described embodiments. Throughout the description, like reference numerals will refer to like parts in the various drawing figures.

For ease of description, the connectors referred to and illustrated herein will be of a type and form suited for connecting a coaxial cable, used for CATV or other data transmission, to an externally threaded port having a ⅜ inch-32 UNEF 2A thread. Those skilled in the art will appreciate, however, that apart from the typically common components of a connector such as, for example, the connector body, the signal connection component(s), and a rotatable, internally threaded nut that attaches the connector to a typical externally threaded port, the specific size, shape and connector assembly details may vary in ways that do not impact the invention per se, and which are not part of the invention per se. Likewise, the externally threaded part of the port may vary in dimension (diameter and length) and configuration. For example, a port may be referred to as a "short" port where the connecting portion has a length of about 0.325 inches. A "long" port may have a connecting length of about 0.500 inches. All of the connecting portion of the port may be threaded, or there may be an unthreaded shoulder immediately adjacent the threaded portion, for example. In all cases, the connector and port must cooperatively engage. According to the embodiments of the present invention, a sealing relationship is provided for the otherwise exposed region between the coaxial cable connector nut and the externally threaded connecting portion of the port.

Figure 2:
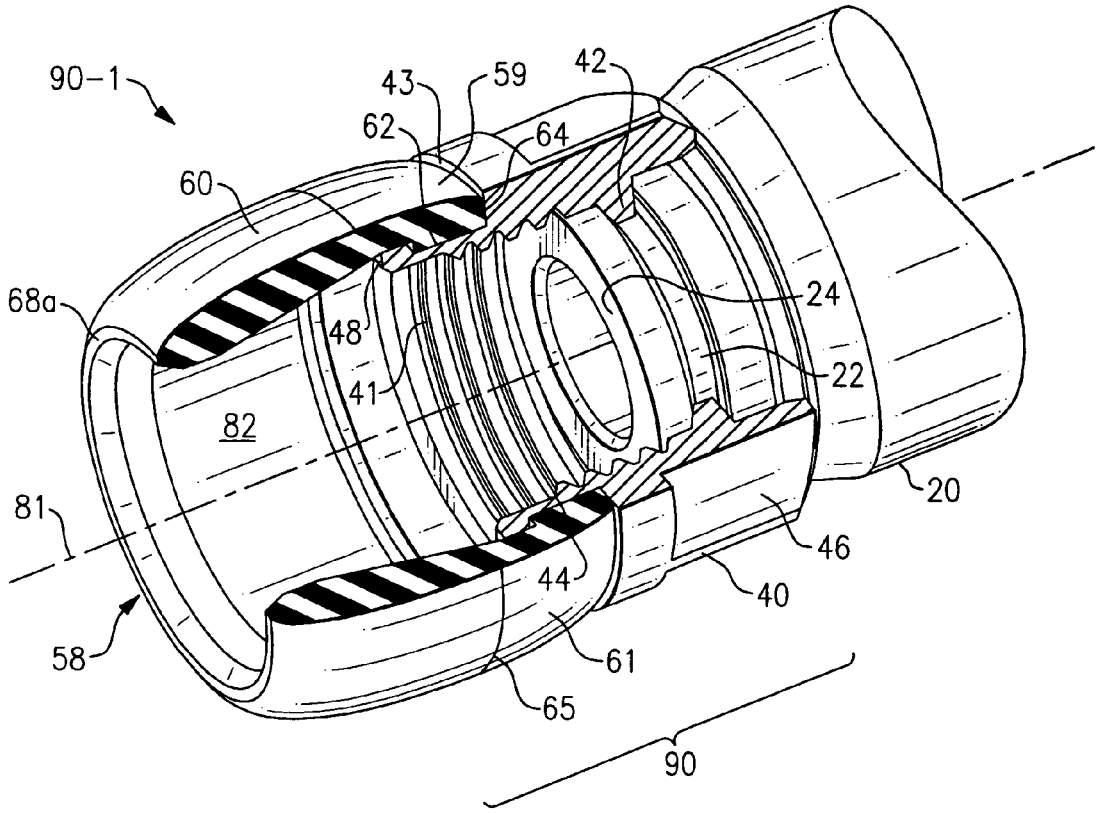
FIG. 2 is an enlarged partially sectioned perspective view of a seal assembly portion of the connector shown in FIG. 1.

A preferred embodiment of the invention is directed to a seal assembly 90 for use with a coaxial connector, exemplary aspects of which are illustrated in FIGS. 2–5. In a general aspect 90-1 illustrated in FIGS. 2 and 3, the seal assembly 90 includes a seal 60 and a nut component 40. The seal and the nut component form an integral assembly as illustrated in FIG. 2.

An exemplary seal 60 is illustrated in FIGS. 1A, 1B, 1C, and FIG. 2. The seal 60 has a generally tubular body that is elastically deformable by nature of its material characteristics and design. In general, the seal 60 is a one-piece element made of a compression molded, elastomer material having suitable chemical resistance and material stability (i.e., elasticity) over a temperature range between about −40° C. to +40° C. A typical material can be, for example, silicone rubber. Alternatively, the material may be propylene, a typical O-ring material. Other materials known in the art may also be suitable. The interested reader is referred to http://www.applerubber.com for an exemplary listing of potentially suitable seal materials. The body of seal 60 has an anterior end 58 and a posterior end 59, the anterior end being a free end for ultimate engagement with a port, while the posterior end is for ultimate connection to the nut component 40 of the seal assembly. The seal has a forward sealing surface 68, a rear sealing portion 61 including an interior sealing surface 62 that integrally engages the nut component (described in greater detail below), and an integral joint-section 65 intermediate the anterior end 58 and the posterior end 59 of the tubular body. The forward sealing surface 68 at the anterior end of the seal 60 may include annular facets 68*a*, 68*b* and 68*c* to assist in forming a seal with the port. Alternatively, forward sealing surface 68 may be a continuous rounded annular surface that forms effective seals through the elastic deformation of the internal surface and end of the seal compressed against the port. The integral joint-section includes a portion of the length of the seal which is relatively thinner in radial cross-section to encourage an outward expansion or bowing of the seal upon its axial compression. In the exemplary embodiment, the nut grasping surface includes an interior sealing surface 62 which forms an annular surface on the inside of the tubular body, and an internal shoulder 67 of the tubular body adjacent the posterior end 59, as illustrated. In its intended use, compressive axial force may be applied against one or both ends of the seal depending upon the length of the port intended to be sealed. The force will act to axially compress the seal whereupon it will expand radially in the vicinity of the integral joint-section 65. In an aspect, the integral joint-section 65 is located axially asymmetrically intermediate the anterior end 58 and the posterior end 59 of the tubular body, and adjacent an anterior end 62' of the interior sealing surface 62, as illustrated. In a preferred embodiment, the tubular body has an interior diameter, D2, at the integral joint-section 65 equal to about 0.44 inches in an uncompressed state. The tubular body has a length, L, from the anterior end 58 to the posterior end 59 of about 0.36 inches in an uncompressed state. However, it is contemplated that the joint-section 65 can be designed to be inserted anywhere between sealing surface 62 and anterior end 58. The seal is designed to prevent the ingress of corrosive elements when the seal is used for its intended function.

Figure 3:
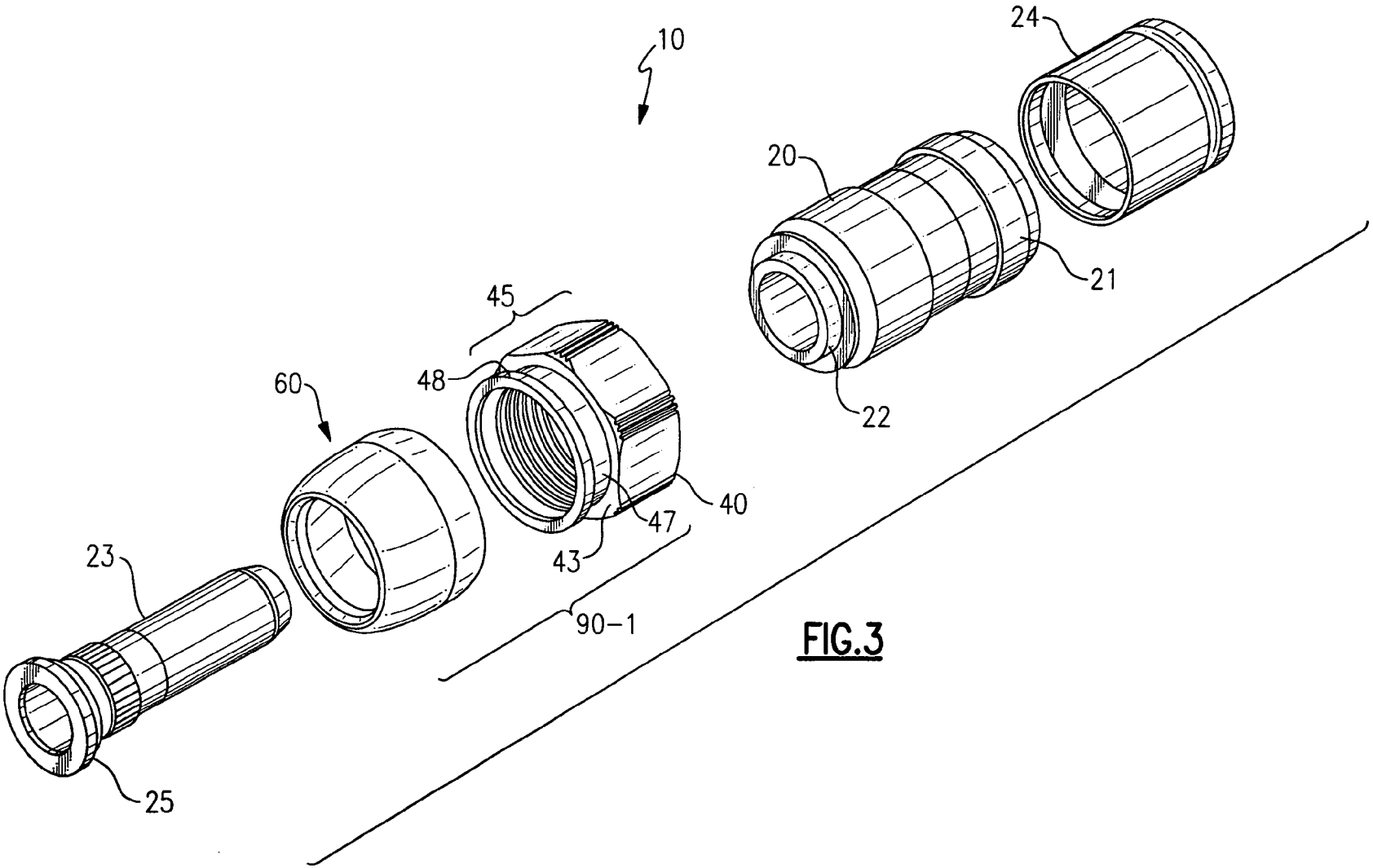
FIG. 3 is an exploded perspective view of a connector according to an exemplary embodiment of the invention.

The nut component 40 of the seal assembly 90, illustrated by example in FIGS. 2 and 3, has an interior surface, at least a portion 41 of which is threaded, a connector-grasping portion 42, and an exterior surface 45 including a seal-grasping surface portion 47. In an aspect, the seal-grasping surface 47 can be a flat, smooth surface or a flat, roughened surface suitable to frictionally and/or adhesively engage the interior sealing surface 62 of the seal 60. In an exemplary aspect, the seal-grasping surface 47 may also contain a ridge 48 that together with the seal grasping surface forms a groove or shoulder that is suitably sized and shaped to correspondingly engage the internal shoulder 67 of the seal adjacent the interior sealing surface 62 in a locking-type interference fit between the nut component 40 and the seal 60 as illustrated in FIG. 2.

The exemplary nut component 40 further includes a nut-turning surface portion 46 on surface 45. In the exemplary aspect shown in FIG. 3, the nut-turning surface portion 46 has at least two flat surface regions that allow engagement with the surfaces of a tool such as a wrench. Typically, the nut-turning surface in this aspect will be hexagonal. Alternatively, the nut turning surface may be a knurled surface to facilitate hand-turning of the nut component. Upon engagement of the seal with the nut component, a posterior sealing surface 64 of the seal abuts a side surface 43 of the nut as shown in FIG. 2 to form a sealing relationship in that region.

In an exemplary aspect, the connector-grasping portion 42 of the nut component 40 is an internally-projecting shoulder that engages a flange 25 on the connector post 23 (described below) in such a manner that the nut component (likewise, the seal assembly 90) can be freely rotated as it is held in place as part of the connector.

Figure 4:
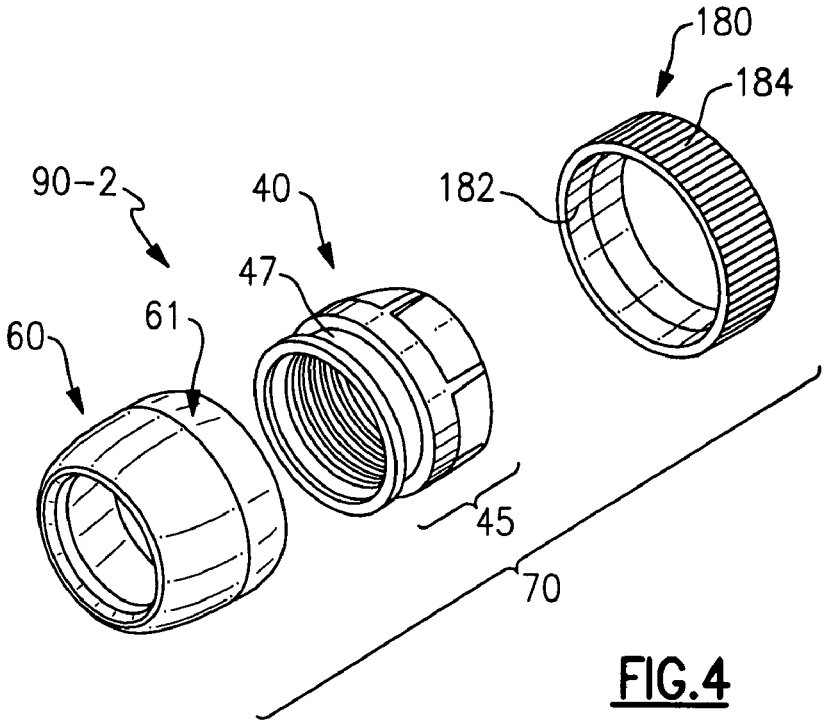
FIG. 4 is an exploded perspective view of a nut seal assembly according to another exemplary embodiment of the invention.

An additional exemplary aspect 90-2 of the seal assembly is illustrated in FIG. 4. The seal assembly of the invention may further include a seal ring 180 having an inner surface 182 and an outer surface 184. The inner surface has a diameter such that the seal ring is slid over the nut component and creates a press-fit against an exterior rear surface portion 61 of the seal that is radially adjacent the interior sealing surface 62. This press fit over the posterior end 59 of the seal 60 enhances the sealing characteristics between the nut 40 and posterior sealing surfaces 62 and 64. In an exemplary aspect, the outer surface 184 of the seal ring 180 is knurled to facilitate hand-turning of the seal assembly. Flat portions 46 of the nut turning surface may remain exposed to additionally facilitate the use of a tool for turning the assembly.

Figure 5:
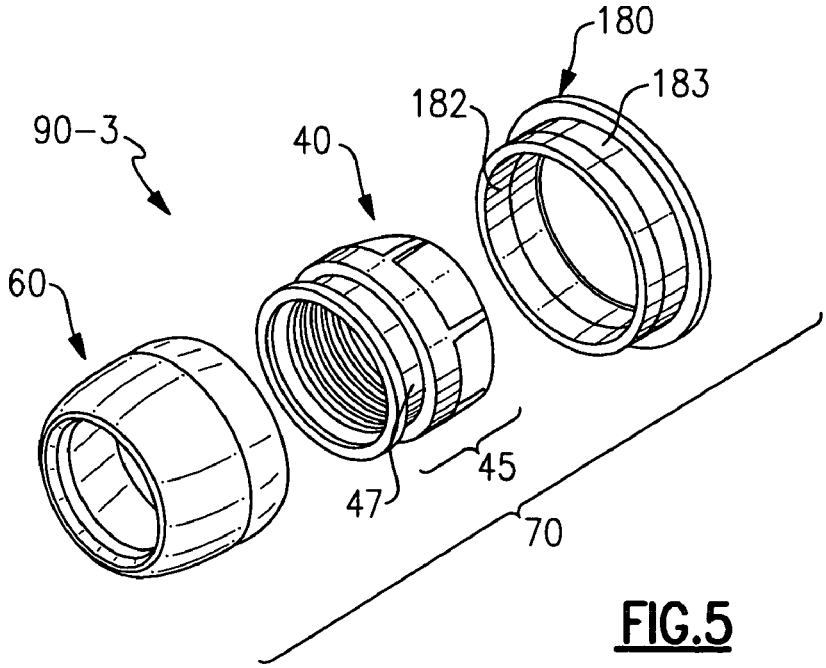
FIG. 5 is an exploded perspective view of a nut seal assembly according to another exemplary embodiment of the invention.

A further exemplary aspect 90-3 of the seal assembly is illustrated in FIG. 5. A seal ring 180' has a flange 183 extending outwardly from a posterior perimeter of the seal ring. As in the case of seal ring 180 described above, an internal surface 182 of seal ring 180' creates a press-fit against the exterior surface portion 61 of the seal that is radially adjacent the interior sealing surface 62. The flange 183 provides a surface that facilitates pushing the seal ring into its assembled position. As described above, flat portions 46 of the nut turning surface may remain exposed to additionally facilitate the use of a tool for turning the assembly.

Figure 6:
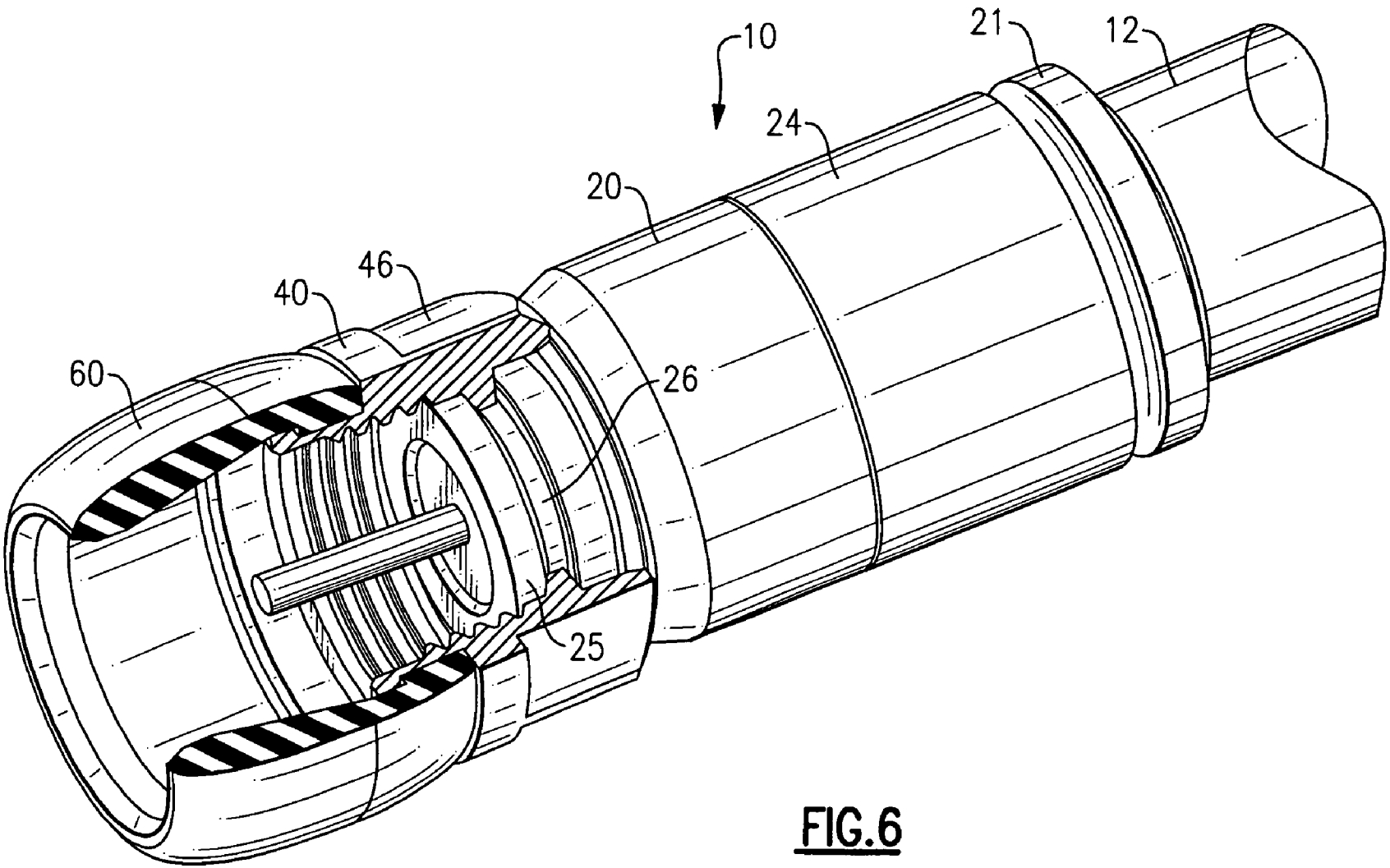
FIG. 6 is a partially sectioned perspective view of a coaxial cable connector in accordance with an exemplary embodiment the invention.
Figure 7:
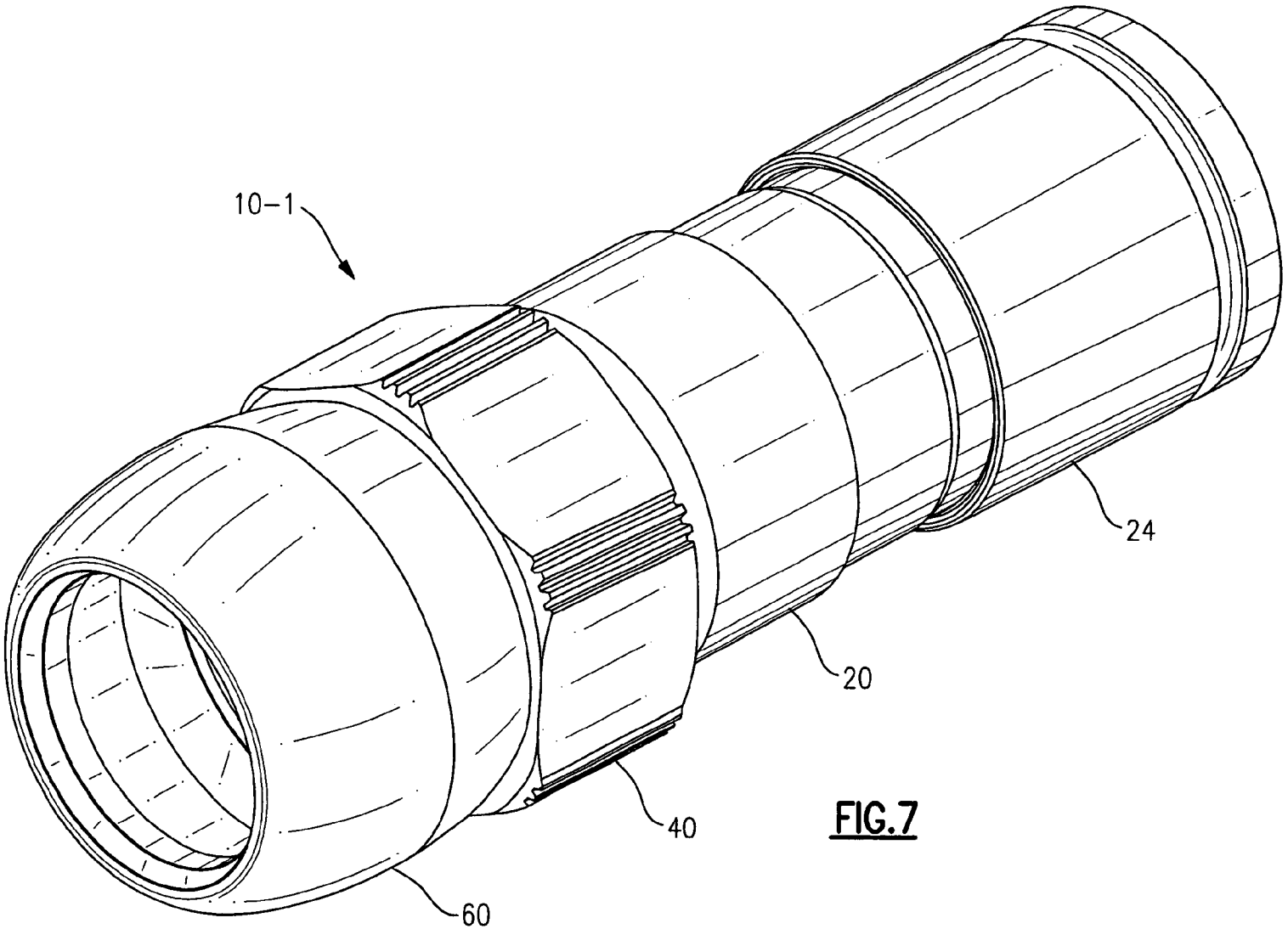
FIG. 7 is a perspective assembled view of the connector incorporating the nut seal assembly shown in FIG. 3.
Figure 8:
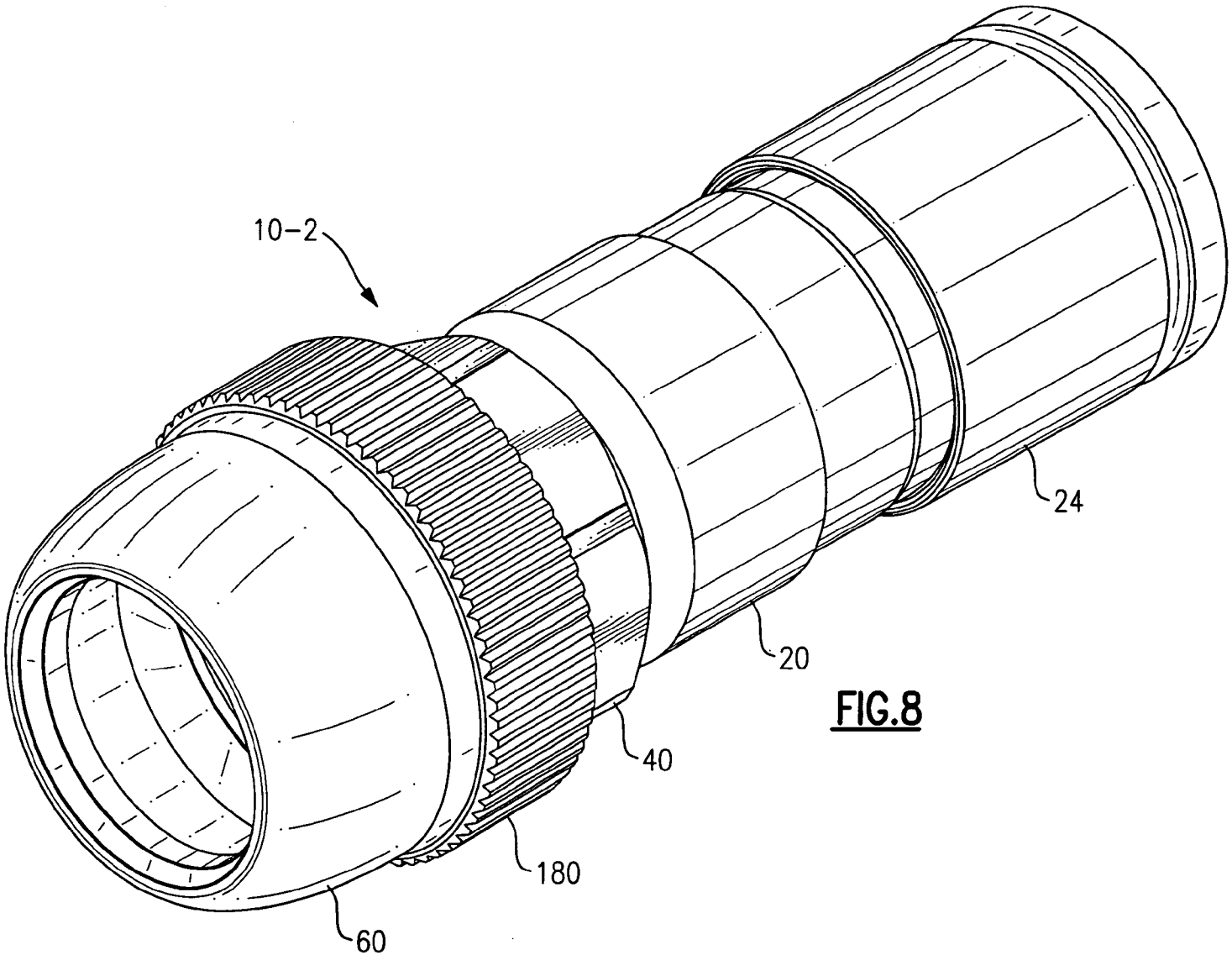
FIG. 8 is a perspective assembled view of the connector incorporating the nut seal assembly shown in FIG. 4.
Figure 9:
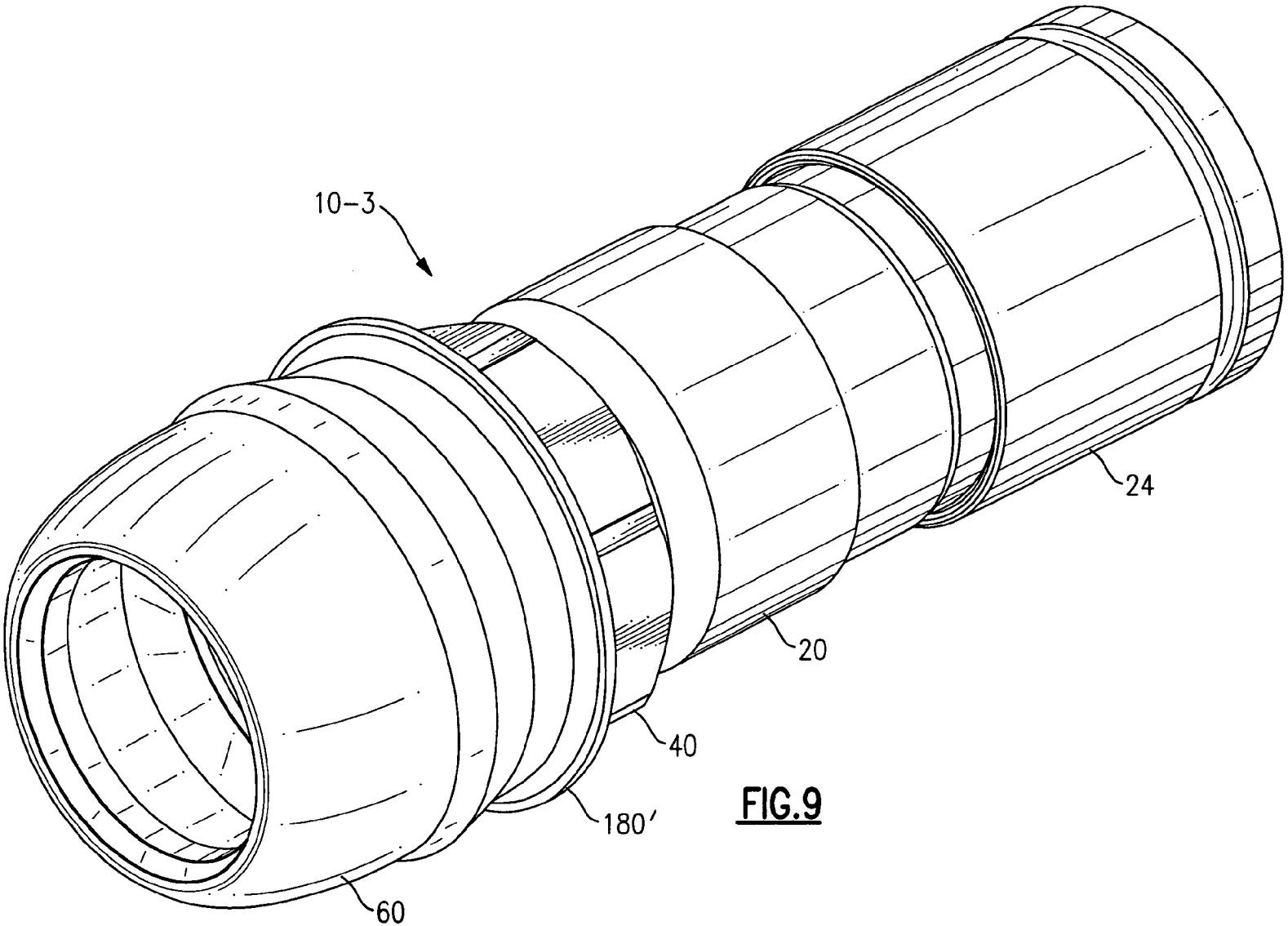
FIG. 9 is a perspective assembled view of the connector incorporating the nut seal assembly shown in FIG. 5.

Another embodiment of the invention is directed to a connector 10 as shown, for example, in FIGS. 3 and 6, for connecting a coaxial cable to a port 100, 110 and 120 as shown for illustration in FIGS. 10–12. The exemplary connector 10, illustrated in exploded view in FIG. 3, includes a tubular connector body 20 having first and second ends 21 and 22, respectively. The connector body 20 accepts and retains a coaxial cable 12 as shown in FIG. 6, by any one of many methods well known in the art. Well known means for attaching a connector body to the cable include hexagonal, circular or conical crimping and the radial compression of components caused by the axial or threaded rotational movement of tapered or stepped sleeves or rings. The exemplary connector 10 includes a connector post 23 that functions, as is well known in the art, to electrically engage the outer conductor of the coaxial cable. Furthermore, the post 23 has a flange 25, which upon assembly with the connector body 20 provides a slot 26 between the flange and the second end 22 of the body 20. Connector 10 further includes a nut component such as nut component 40 described above. The connector grasping shoulder 42 of the nut component 40 shown in FIG. 2 engages the slot 26, allowing the nut component to be an integral, rotatable part of the connector upon assembly. In the exemplary connector 10, a compression ring 24 slides over the connector body 20 to secure the integrity of the connector assembly. As described previously, seal 60 and nut component 40 form integral seal assembly 90, which are part of connector 10. A cut-away view of exemplary connector 10 is shown in FIG. 6 and, as assembled, as connector 10-1 in FIG. 7. Alternative exemplary connectors 10-2, 10-3, incorporating respective seal assemblies 90-2, 90-3, are illustrated in FIGS. 8 and 9, respectively.

Figure 10A:
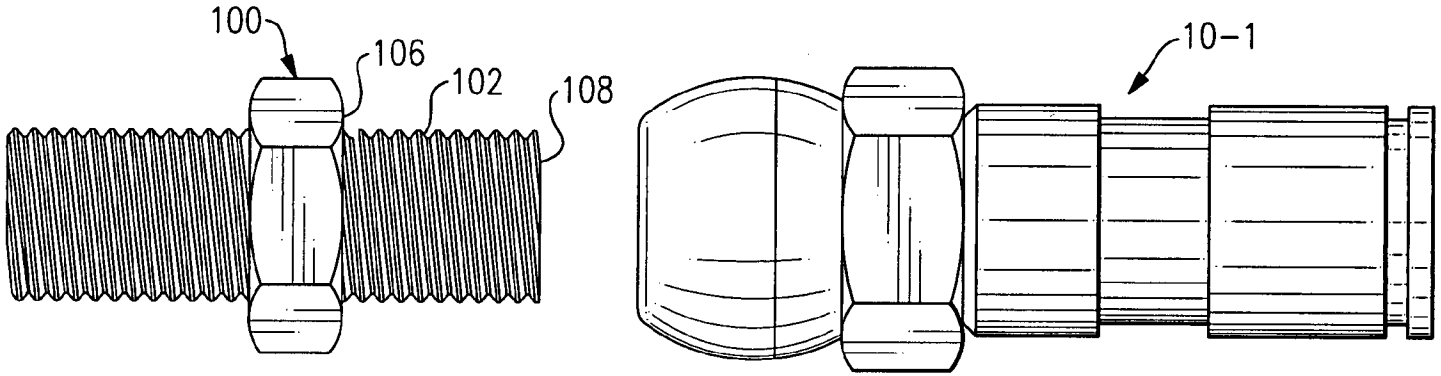
FIG. 10A is a plan view of an exemplary connector prior to engagement with an illustrative externally threaded port.

Exemplary illustrations of the intended use and configurations of connector 10 are shown in FIGS. 10–12. Referring to FIG. 10A, connector 10-1 is positioned in axial alignment with a "short" externally threaded port 100. Short port 100 has a length of external threads 102 extending from a terminal end 104 to an enlarged shoulder 106. The length of the external threads 102 is shorter than the length, L, of seal 60 (i.e., seal 60 in uncompressed state).

Figure 10B:
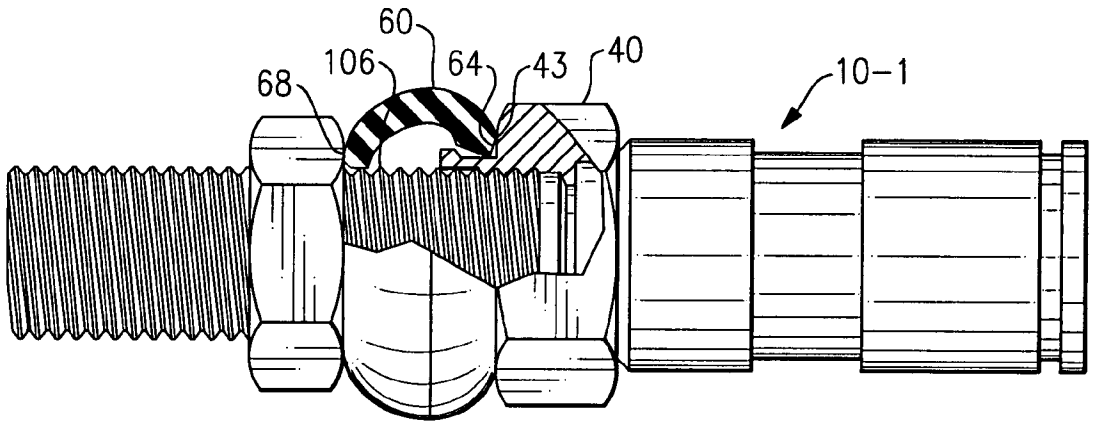
FIG. 10B is a partially sectioned plan view of the exemplary connector in FIG. 10A upon complete engagement with the illustrative externally threaded port.

Referring to FIG. 10B, connector 10-1 and short port 100 are shown "connected". Seal 60 is axially compressed between nut 40 and enlarged shoulder 106 of port 100. Posterior sealing surface 64 is axially compressed against side surface 43 of nut 40 and the end face 68*a* of forward sealing surface 68 is axially compressed against enlarged shoulder 106 thus preventing ingress of environmental elements between nut 40 and enlarged shoulder 106 of the port 100.

Figure 11A:
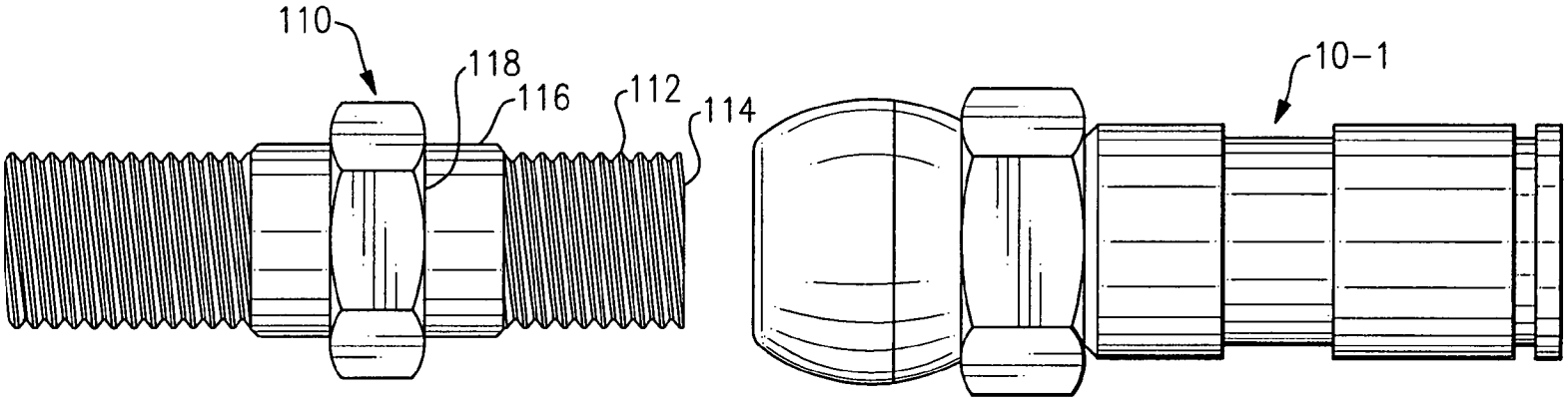
FIG. 11A is a plan view of an exemplary connector prior to engagement with a different illustrative externally threaded port.

Referring to FIG. 11A, connector 10-1 is positioned in axial alignment with a "long" externally threaded port 110. Long port 110 is characterized by having a length of external threads 112 extending from a terminal end 114 of port 110 to an unthreaded diameter 116 that is approximately equal to the major diameter of external threads 112. Unthreaded portion 116 then extends from external threads 112 to an enlarged shoulder 118. The length of external threads 112 in addition to unthreaded portion 116 is longer than the length that seal 60 extends outward from side surface 63 when seal 60 is in an uncompressed state.

Figure 11B:
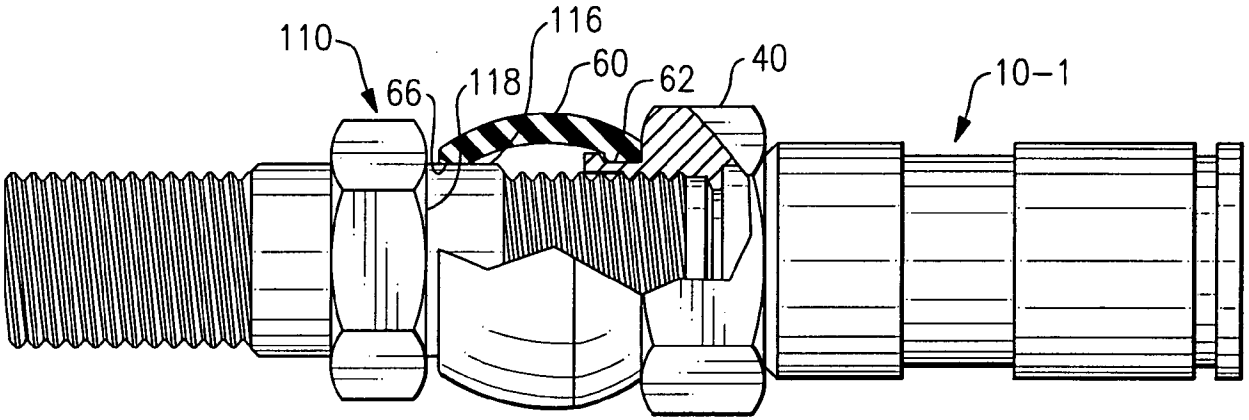
FIG. 11B is a partially sectioned plan view of the exemplary connector in FIG. 11A upon complete engagement with the illustrative externally threaded port.

Connector 10-1 and long port 110 are shown connected in FIG. 11B. Seal 60 is not axially compressed between nut 40 and enlarged shoulder 118. Rather, internal sealing surface 62 is radially compressed against the seal grasping surface 47 of nut 40 and the interior portion 68*b* and 68*c* of forward sealing surface 68 are radially compressed against unthreaded portion 116, preventing the ingress of environmental elements between nut 40 and unthreaded portion 116 of port 110. The radial compression of both internal sealing surface 62 against seal grasping surface 47 of nut 40 and forward sealing surface 68 against unthreaded portion 116 is created by an interference fit between the sealing surfaces and their respective mating surfaces.

Figure 12A:
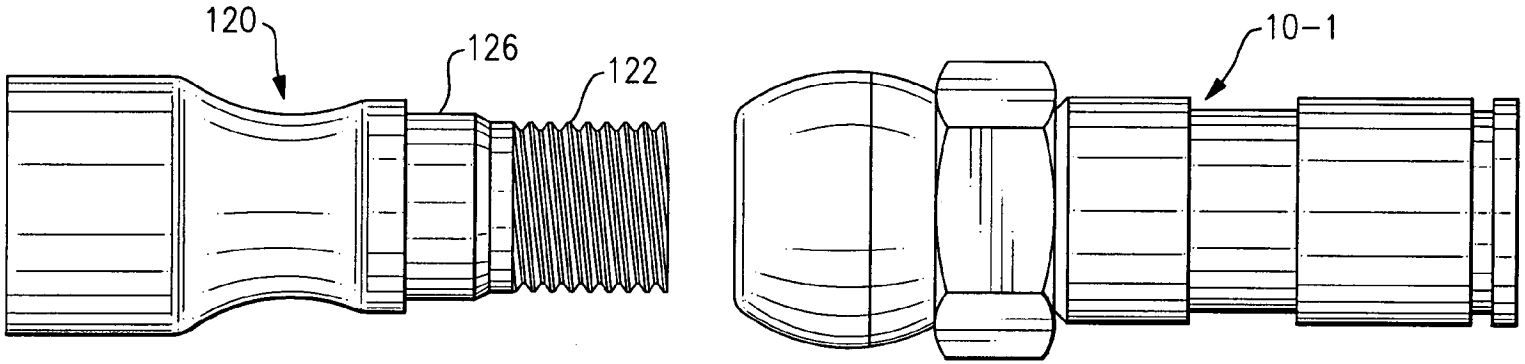
FIG. 12A is a plan view of an exemplary connector prior to engagement with a different illustrative externally threaded port.

FIG. 12A shows connector 10-1 positioned in axial alignment with an alternate externally threaded port 120. The portions 126, 122 of alternate port 120 are similar to those of long port 110 (FIG. 11), however, the diameter of the unthreaded portion 126 is larger than the major diameter of the external threads 122.

Figure 12B:
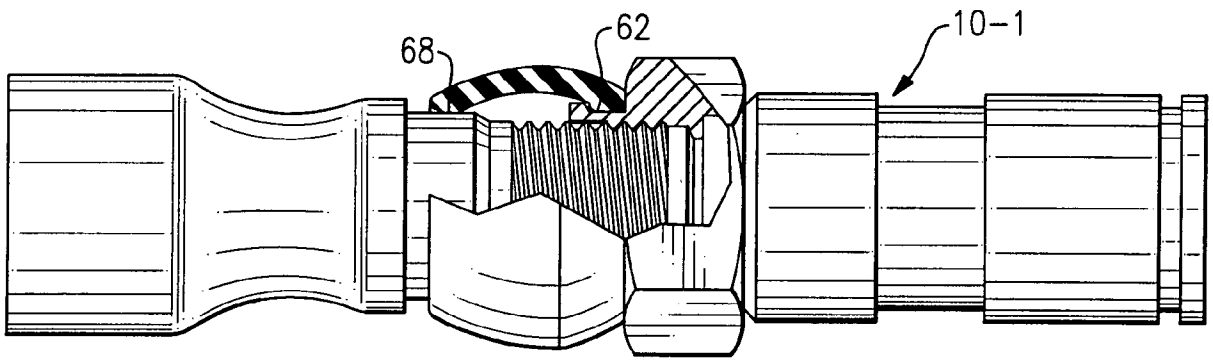
FIG. 12B is a partially sectioned plan view of the exemplary connector in FIG. 12A upon complete engagement with the illustrative externally threaded port.

As shown in FIG. 12B, connector 10-1 is connected to alternate port 120. Internal sealing surface 62 is radially compressed against seal grasping surface 47 of nut 40 and forward sealing surface 68 is radially compressed against unthreaded portion 126, preventing the ingress of environmental elements between nut 40 and unthreaded portion 126. The radial compression of both the internal sealing surface 62 against seal grasping surface 47 of nut 40 and forward sealing surface 68 against unthreaded portion 126 is created by an interference fit between the sealing surfaces and their respective mating surfaces.

Figure 13:
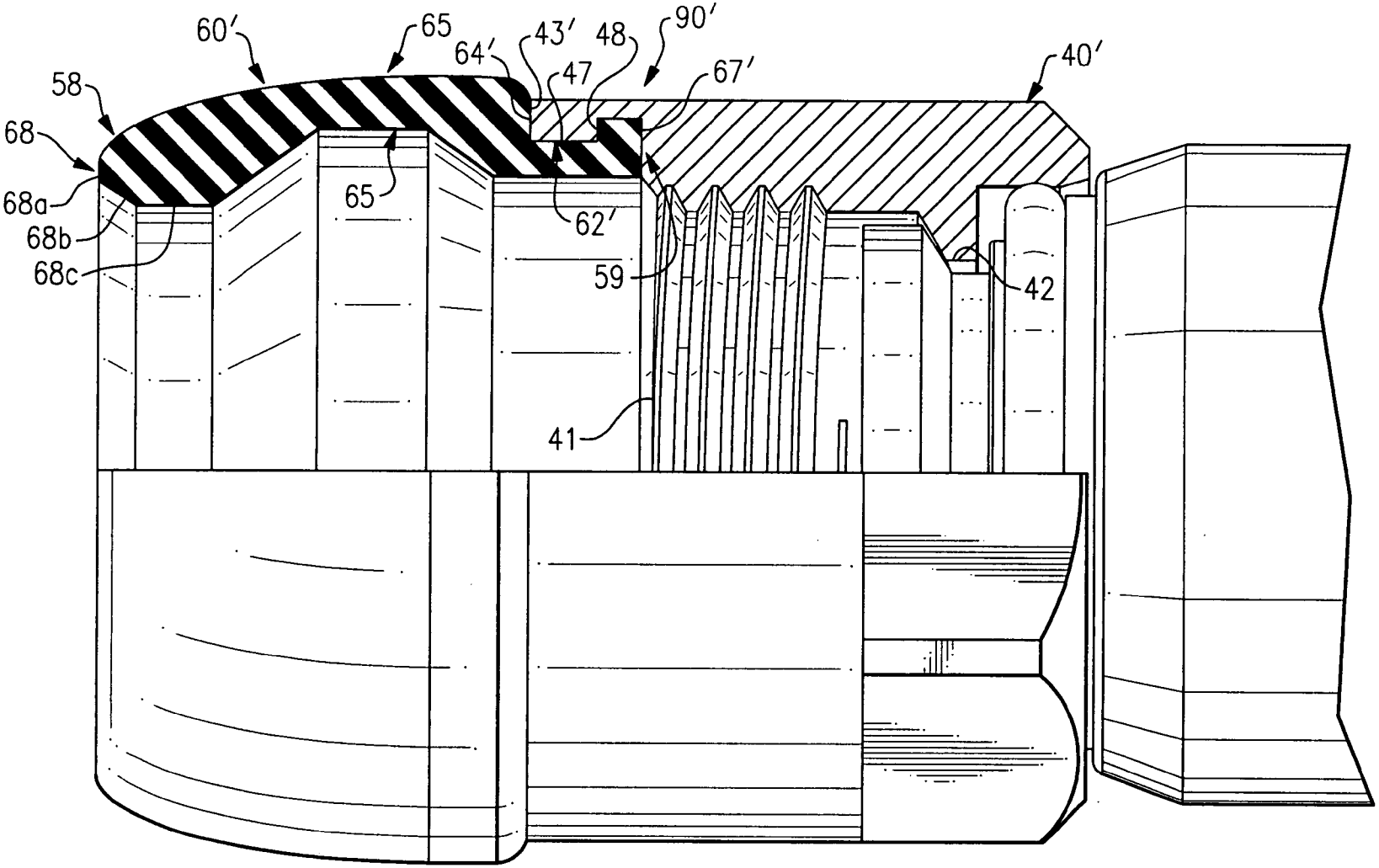
FIG. 13 is a partial cross sectional view of a modified embodiment of a seal assembly portion of the invention.
Figure 14:
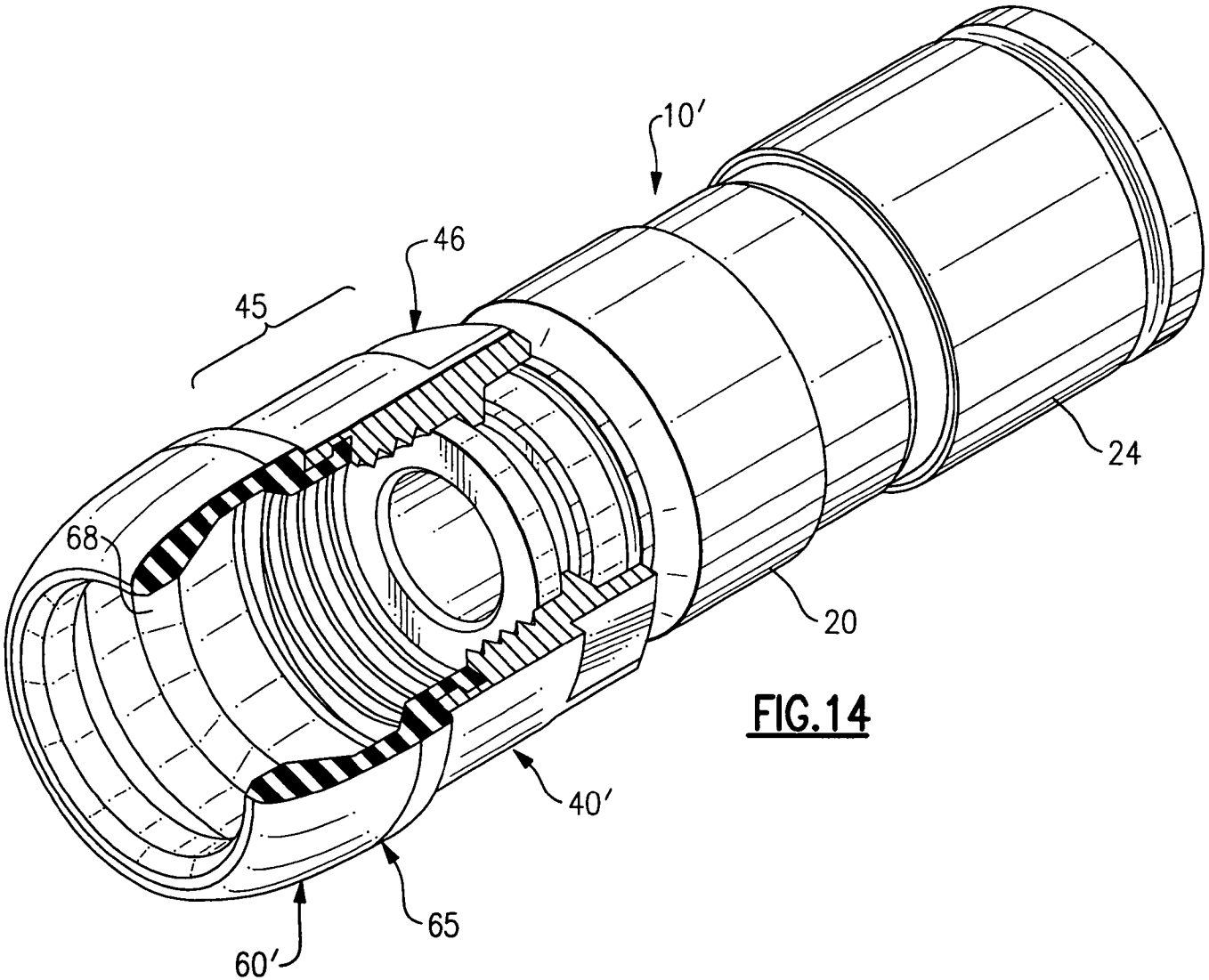
FIG. 14 is a partially sectioned perspective view of a modified alternative embodiment of a seal assembly portion of the invention.

A modified embodiment of the seal assembly 90' is illustrated in FIGS. 13 and 14. The materials function and operation of the modified embodiment of the seal assembly is substantially similar to the exemplary embodiment described above with the exception that the posterior portion of the seal 60' attaches to the interior surface rather than the exterior surface of the nut component 40'. The modified embodiment of the seal also has a generally tubular body that is elastically deformable by nature of its material characteristics and design. The tubular body of seal 60' has an anterior end 58 and a posterior end 59, the anterior end being a free end for ultimate engagement with a port, while the posterior end is for ultimate connection to the nut component 40' of the alternative seal assembly. The seal has a forward sealing surface 68 that may either have facets or a continuously curved surface, a rear sealing portion 61 including an exterior sealing surface 62' that integrally engages the nut component (described in greater detail below), and an integral joint-section 65 intermediate the anterior end 58 and the posterior end 59 of the tubular body. The sealing surface 62' is an annular surface on the exterior of the tubular body. The seal 60' may also have a ridge 67' at the posterior end 59 which together with the nut grasping surface 62' locks in an interference fit with a corresponding shoulder 48 on the nut component 40', as illustrated. In its intended use, compressive axial force may be applied against one or both ends of the seal depending upon the length of the port intended to be sealed. The force will act to axially compress the seal whereupon it will expand radially in the vicinity of the integral joint-section 65.

The nut component 40' of the modified seal assembly 90' and connector 10', illustrated by example in FIGS. 13 and 14, has an interior surface, at least a portion 41 of which is threaded, a connector-grasping portion 42, and an interior surface including a seal-grasping surface portion 47. In an aspect, the seal-grasping surface 47 can be a flat, smooth surface or a flat, roughened surface suitable to frictionally and/or adhesively engage the interior sealing surface 62' of the seal 60'. In an aspect, the seal-grasping surface 47 contains a shoulder 48 that is suitably sized and shaped to engage the ridge 67 of the posterior end 59 of the seal 60' sealing surface groove 62' in a locking-type interference fit as illustrated in FIGS. 13 and 14.

The modified nut component 40' further includes nut-turning surface portions 46 on surface 45. Upon engagement of the seal with the nut component, a sealing surface 64' of the seal abuts a end surface 43' of the nut as shown in FIGS. 13 and 14 to form a sealing relationship in that region. This modified embodiment of the seal assembly may be substituted for the preferred seal assembly of FIGS. 4 through 9 in the exemplary embodiments incorporating connectors and seal rings as described above.

Figure 15:
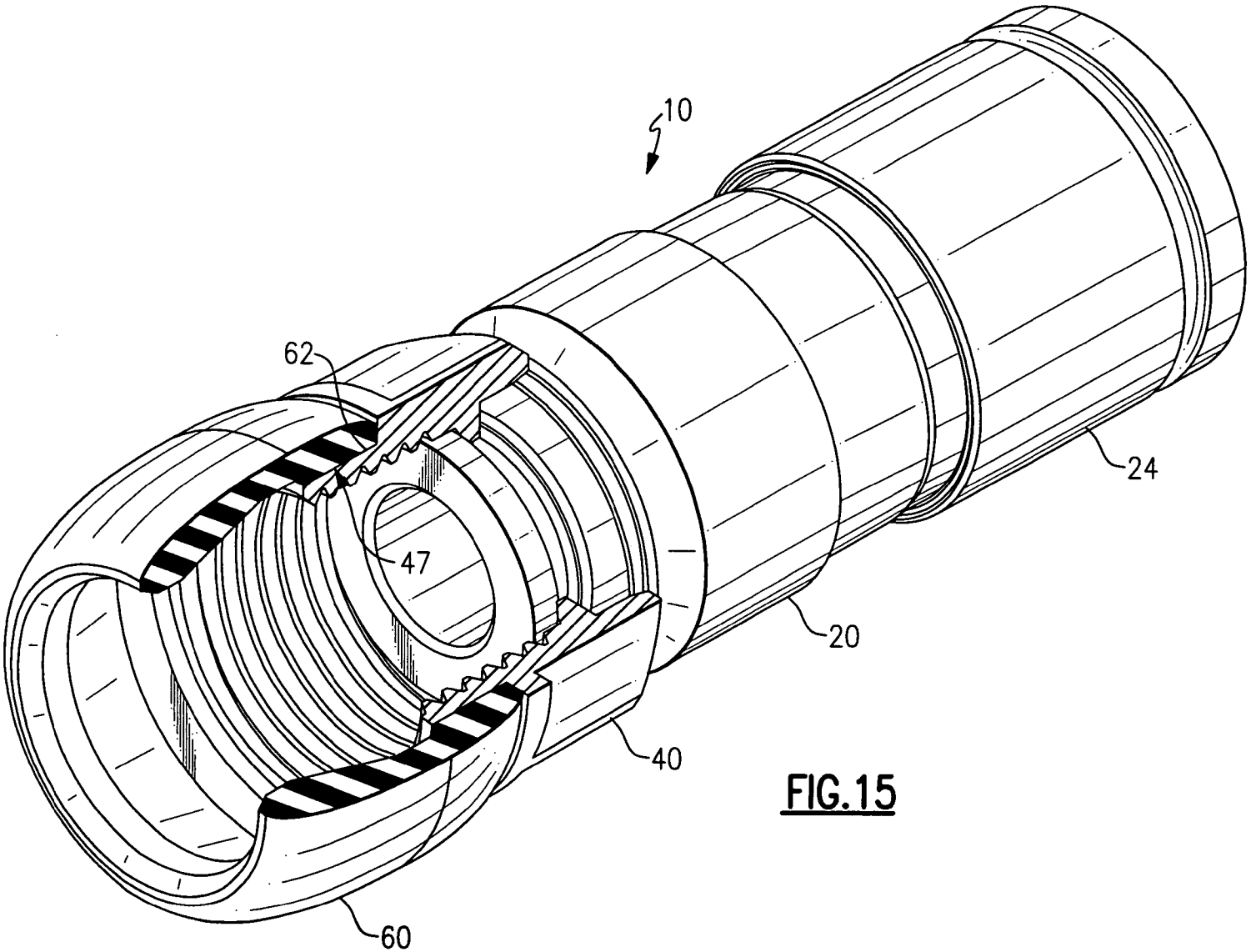
FIG. 15 is a partially sectioned perspective view of a second modified embodiment of a seal assembly portion of the invention.
Figure 16:
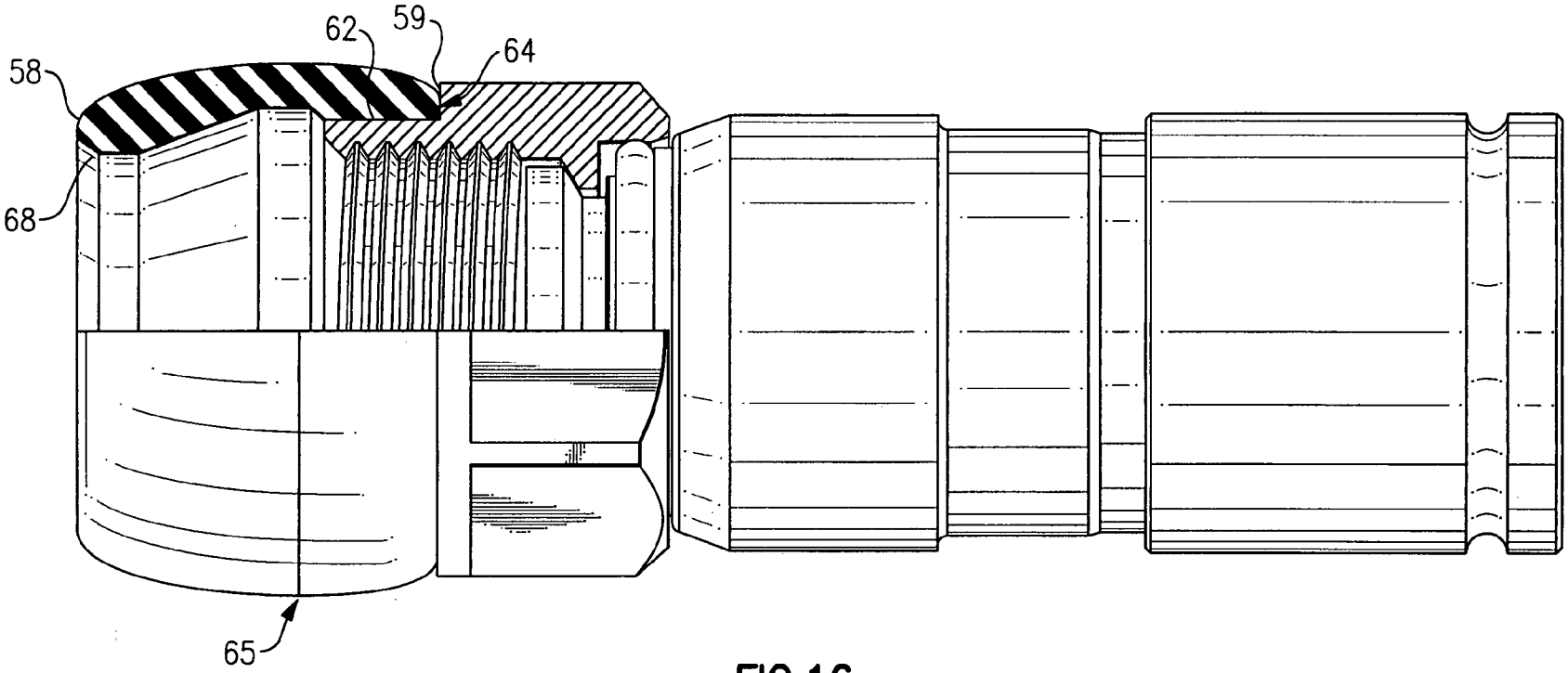
FIG. 16 is a partial cross sectional view of a second modified embodiment of a seal assembly portion of the invention.

A second modified embodiment of the seal assembly is illustrated in FIGS. 15 and 16. The seal-grasping surface 47 similarly can be a flat, smooth surface or a flat, roughened surface suitable to frictionally and/or adhesively engage the interior sealing surface of the seal 60. In this modified embodiment, however, the forward ridge that formed the interlocking interference fit between corresponding shoulders 48 and 67 of the nut and the seal, respectively, have been eliminated. Rather, the nut seal is retained on the seal grasping surface due to either the compressive force of the elastomer material of the seal member on the seal grasping surface 47 or the frictional forces between these surfaces, alone or in conjunction with an adhesive bond between the seal grasping surface 47of the nut 40 and the nut grasping surface 62 of the seal 60. In all other aspects, this second modified embodiment of the nut seal assembly and connectors incorporating the same operate in the same manner as exemplary embodiment of the assembly discussed above and depicted in FIGS. 1 through 12.

While the invention has been described in terms of exemplary embodiments and aspects thereof, and with reference to the accompanying drawings, it will be understood by those skilled in the art that the invention is not limited to the exemplary and illustrative embodiments. Rather, various modifications and the like could be made thereto without departing from the scope of the invention as defined in the appended claims.

I claim:

1. A coaxial cable connector nut seal assembly comprising:

a nut component having a first end, a second end and an interior surface configured for engagement with a radio frequency port, said interior surface including an internal shoulder for engagement with one of a connector body or a post; and a seal-grasping surface portion and a seal having an elastically deformable body attached to the nut component, said seal capable of accommodating different length radio frequency ports, said body having a posterior sealing surface that cooperatively engages the seal-grasping surface portion of the nut component and a forward sealing surface that extends axially beyond the first end of the nut component and cooperatively engages the radio frequency port, wherein the seal and nut form an integrated seal assembly.

2. The seal assembly of claim 1, wherein at least part of the seal-grasping portion is one of a smooth surface and a roughened surface suitable to frictionally engage the posterior sealing surface of the seal.

3. The seal assembly of claim 2, wherein the seal-grasping portion further comprises a ridge on the exterior surface of the nut component.

4. The seal assembly of claim 1, wherein at least part of the seal-grasping portion is a surface suitable to adhesively engage the posterior sealing surface of the seal.

5. The seal assembly of claim 1, wherein the nut component further includes a nut-turning surface portion along an external perimeter surface of the nut component.

6. The seal assembly of claim 5, wherein the nut-turning surface portion has at least two flat surface regions.

7. The seal assembly of claim 1, wherein the body of the seal includes an integral joint-section.

8. The seal assembly of claim 1, wherein an integral joint-section is located asymmetrically between an anterior end of the seal and a posterior end of the seal.

9. The seal assembly of claim 1, wherein the body is made of a compression molded elastic material.

10. The seal assembly of claim 9, wherein the body is a silicone rubber material.

11. The seal assembly of claim 9, wherein the body is a propylene material.

12. The seal assembly of claim 1, wherein the seal has an axial length in an uncompressed state that is sufficient to fully cover a length of external threads on the port when the port is in a fully connected relationship with the seal assembly.

* * * * *